US009964288B1

(12) United States Patent
Stefanoff

(10) Patent No.: US 9,964,288 B1
(45) Date of Patent: May 8, 2018

(54) SEMICONDUCTOR LIGHTING ASSEMBLIES AND METHODS FOR RETROFITTING EXISTING LIGHTING ASSEMBLIES

(71) Applicant: Buddy Stefanoff, Owasso, OK (US)

(72) Inventor: Buddy Stefanoff, Owasso, OK (US)

( * ) Notice: Subject to any disclaimer, the term of this patent is extended or adjusted under 35 U.S.C. 154(b) by 129 days.

(21) Appl. No.: 14/517,773

(22) Filed: Oct. 17, 2014

Related U.S. Application Data

(60) Provisional application No. 61/892,286, filed on Oct. 17, 2013, provisional application No. 61/947,964, filed on Mar. 4, 2014.

(51) Int. Cl.

| | |
|---|---|
| ***F21V 17/06*** | (2006.01) |
| ***F21V 17/00*** | (2006.01) |
| ***F21S 8/08*** | (2006.01) |
| ***F21K 99/00*** | (2016.01) |
| ***F21V 29/70*** | (2015.01) |
| ***F21V 13/04*** | (2006.01) |
| *F21V 17/08* | (2006.01) |
| *F21Y 101/02* | (2006.01) |
| *F21W 131/103* | (2006.01) |

(52) U.S. Cl.
CPC ..... *F21V 17/002* (2013.01); *F21K 9/1355* (2013.01); *F21S 8/086* (2013.01); *F21V 13/04* (2013.01); *F21V 29/70* (2015.01); *F21W 2131/103* (2013.01); *F21Y 2101/02* (2013.01)

(58) Field of Classification Search
CPC ..... F21V 17/002; F21V 29/70; F21V 13/04; F21V 19/0035; F21V 17/02; F21V 13/14; F21K 9/1355; F21S 8/085; F21S 8/086
See application file for complete search history.

(56) References Cited

U.S. PATENT DOCUMENTS

| | | | | |
|---|---|---|---|---|
| 2011/0068708 | A1* | 3/2011 | Coplin | F21K 9/00 315/294 |
| 2012/0152490 | A1* | 6/2012 | Wen | F21V 29/507 165/67 |
| 2014/0177226 | A1* | 6/2014 | Goelz | F21V 29/2212 362/294 |

* cited by examiner

*Primary Examiner* — Anh Mai
*Assistant Examiner* — Nathaniel Lee
(74) *Attorney, Agent, or Firm* — John M. Behles

(57) ABSTRACT

Semiconductor lighting and retrofitting methods are provided herein. One method includes providing a roadway light that has a housing, the roadway light having at least a ballast, an high intensity discharge lamp, a reflector, a lens removed there from, the roadway light having a legacy bracket and a legacy mount disposed in a sidewall of the housing that remain, and coupling an assembly to the legacy bracket, the assembly including at least a plurality of light emitting diode (LED) lights mounted to the heat sink, the plurality of LED lights being disposed in a linear arrangement, and a support plate that is joined to the heat sink, the support plate having a mating bracket that couples with the legacy bracket disposed within a housing of the roadway light.

18 Claims, 17 Drawing Sheets

SEMICONDUCTOR LIGHTING ASSEMBLIES AND METHODS FOR RETROFITTING EXISTING LIGHTING ASSEMBLIES

CROSS REFERENCE TO RELATED APPLICATIONS

This application claims the priority benefit of U.S. Provisional Application Ser. No. 61/892,286, filed on Oct. 17, 2013, titled "SEMICONDUCTOR LIGHTING ASSEMBLIES AND METHODS FOR RETROFITTING EXISTING LIGHTING ASSEMBLIES", which is hereby incorporated by reference herein in its entirety, including all references cited therein. This application also claims the priority benefit of U.S. Provisional Application Ser. No. 61/947,964, filed on Mar. 4, 2014, titled "SEMICONDUCTOR LIGHTING ASSEMBLIES AND METHODS FOR RETROFITTING EXISTING LIGHTING ASSEMBLIES", which is also hereby incorporated by reference herein in its entirety, including all references cited therein.

FIELD OF THE PRESENT TECHNOLOGY

The present technology relates generally to semiconductor lighting, and more specifically, but not by way of limitation, to light emitting diode (LED) assemblies that can be utilized to manufacture high efficiency lighting fixtures. Further, the LED assemblies of the present technology may be retrofit into existing lighting fixtures such as street lights and street lamps, as well as other lighting fixtures.

SUMMARY

According to some embodiments, the present technology is directed to an assembly for retrofitting a roadway light, the assembly comprising: (a) a heat sink; (b) a plurality of light emitting diode (LED) lights mounted to the heat sink, the plurality of LED lights being disposed in a linear arrangement that is aligned with a long axis of a housing of the retrofit roadway light; (c) a support plate having openings that receive the plurality of LED lights, the support plate being joined to the heat sink, the support plate comprising a mating bracket that includes means for coupling the support plate to a legacy bracket disposed within a housing of the roadway light, the support plate being joined to the legacy bracket by the means for coupling the support plate to a legacy bracket; (d) a v-shaped bracket installed onto a legacy mount that is integrated into a sidewall of the housing, the support plate being joined to flattened ends of the v-shaped bracket; and (e) a transparent film to cover an opening of a lower portion of the housing.

According to some embodiments, the present technology is directed to a method comprising; (a) opening a housing of a roadway light that comprises a ballast, a high intensity discharge lamp, such as a metal halide, low or high pressure sodium a reflector, a lens, a legacy bracket, and a legacy mount disposed in a sidewall of the housing; (b) removing the lens, which is associated with a lower portion of the housing to create an opening in the lower portion; (c) removing the ballast, the high intensity discharge lamp, and the reflector; and (d) coupling an assembly to the legacy bracket, the assembly comprising: (1) a plurality of light emitting diode (LED) lights mounted to the heat sink, the plurality of LED lights being disposed in a linear arrangement that is aligned with a long axis of a housing of the retrofit roadway light; and (2) a support plate having openings that receive the plurality of LED lights, the support plate being joined to the heat sink, the support plate comprising a mating bracket that includes means for coupling the support plate to a legacy bracket disposed within a housing of the roadway light, the support plate being joined to the legacy bracket by the means for coupling the support plate to a legacy bracket.

BRIEF DESCRIPTION OF THE DRAWINGS

Certain embodiments of the present technology are illustrated by the accompanying figures and/or photographs. It will be understood that the figures are not necessarily to scale and that details not necessary for an understanding of the technology or that render other details difficult to perceive may be omitted. It will be understood that the technology is not necessarily limited to the particular embodiments illustrated herein.

DETAILED DESCRIPTION OF EXEMPLARY EMBODIMENTS

Figure 1A:
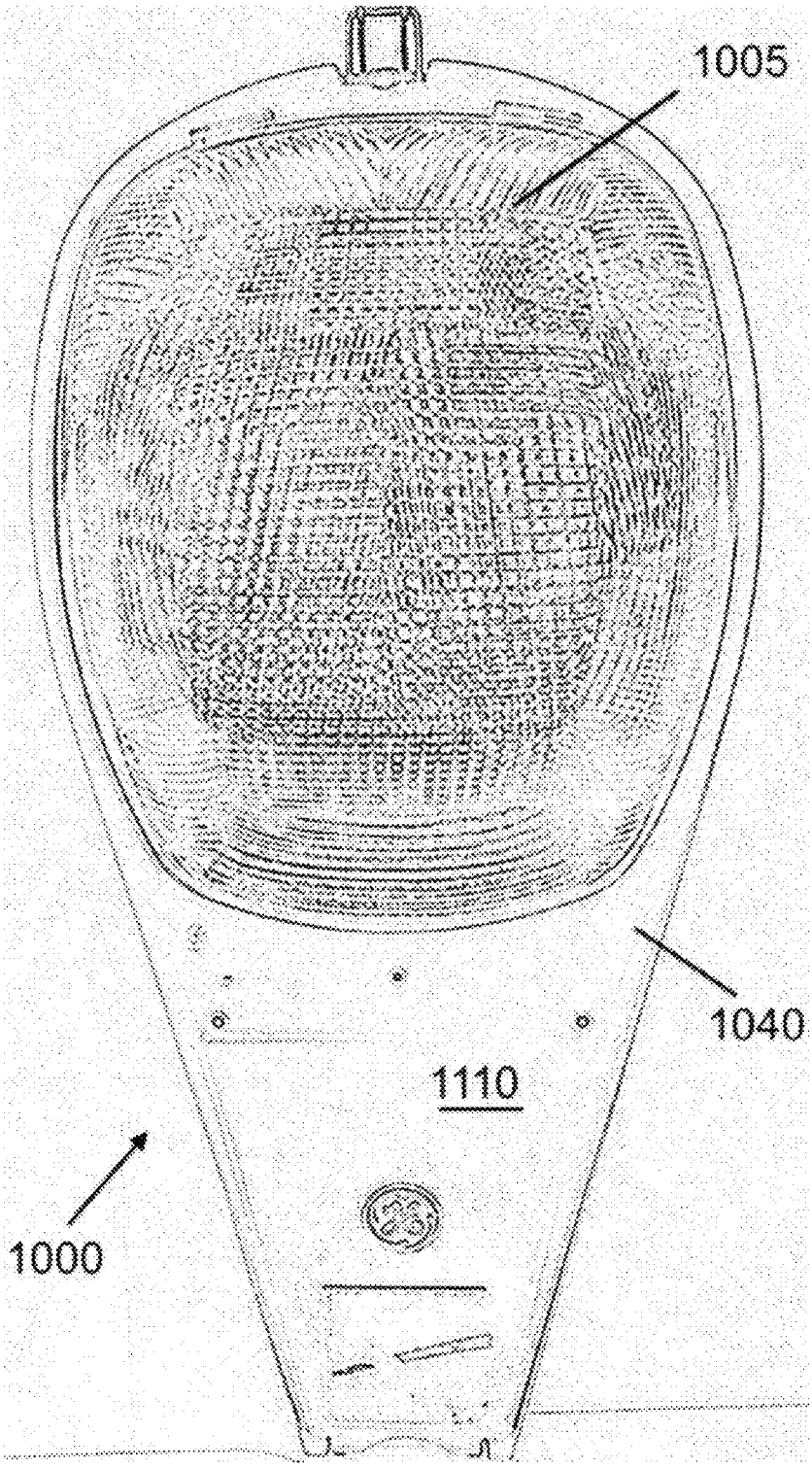
PRIOR ART FIG. 1A
FIGS. 1A-E collectively illustrate a legacy roadway light to be retrofitted with an LED lighting assembly of the present technology, also illustrating the deconstruction of the roadway light.

While this technology is susceptible of embodiment in many different forms, there is shown in the drawings, and will herein be described in detail, several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology.

As such, some of the components may have been distorted from their actual scale for pictorial clarity.

Reference throughout this specification to "one embodiment" or "an embodiment" means that a particular feature, structure, or characteristic described in connection with the embodiment is included in at least one embodiment of the present invention. Thus, the appearances of the phrases "in one embodiment," or "in an embodiment," or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its non-italicized version (e.g., "N+1"). Such occasional interchangeable uses shall not be considered inconsistent with each other.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected," "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purpose only, and are not drawn to scale.

Generally, the present technology is directed to LED assemblies that are used to retrofit or manufacture roadway lighting fixtures. Broadly, the present technology may be used to retrofit existing lighting fixtures, such as street lamps. As background, a street lamp may be configured with light sources such as incandescent, high intensity discharge (HID), or high-pressure sodium (HPS) light bulbs. Further, these street lamps utilize internal reflectors and a bowl-shaped reflector cover, such as a borosilicate lens, that is faceted to direct the light emitted by the light bulb over a specified area. The light emitted by the street lamp is often measured in terms of "foot-candles". Adequate lighting levels of workspaces in buildings or outdoor spaces are often measured in units referred to as foot-candles, which represents how widely the light from a fixture is dispersed downwardly from the light onto a surface below.

Figure 1B:
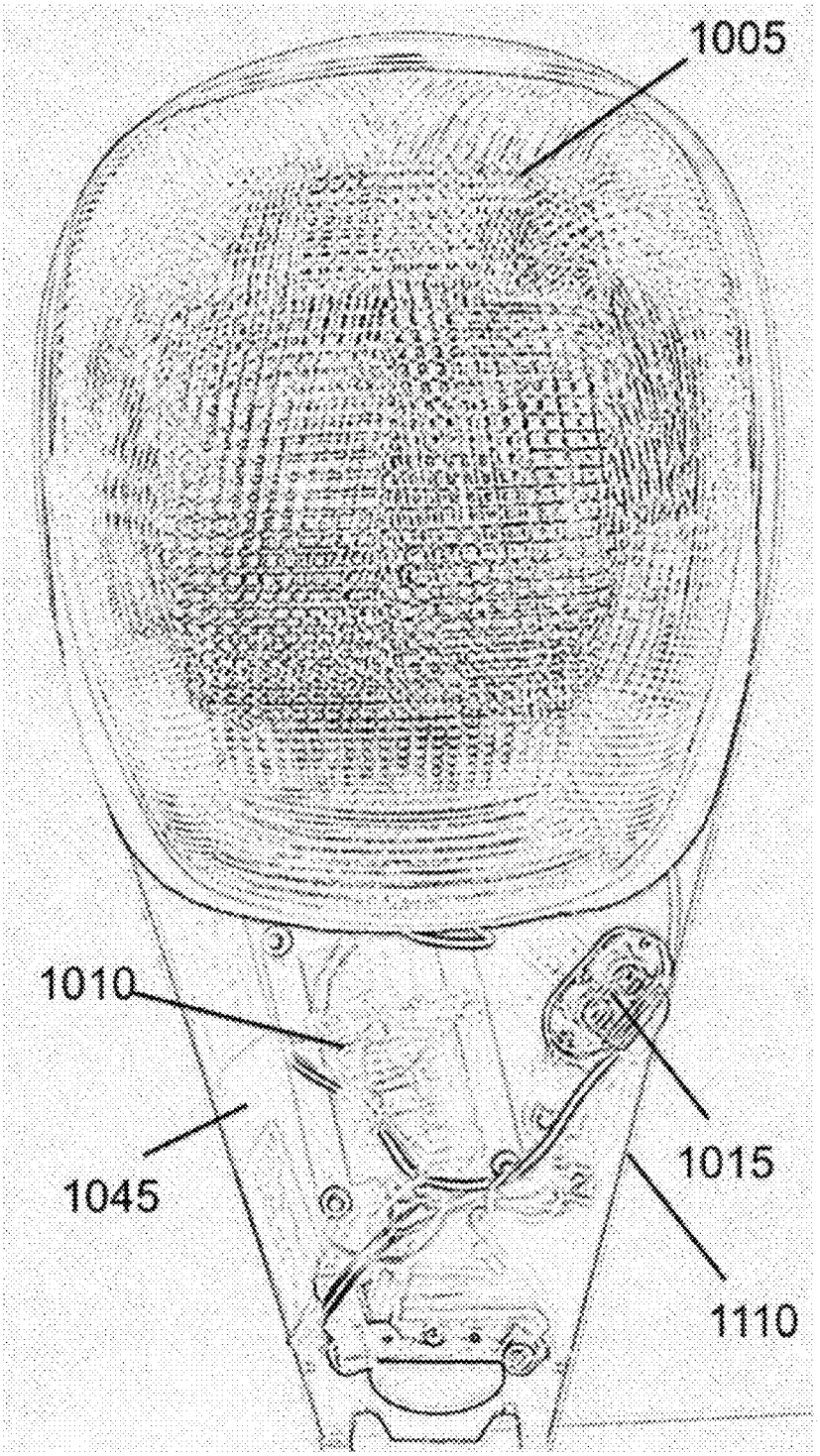
PRIOR ART FIG. 1B
Figure 1C:
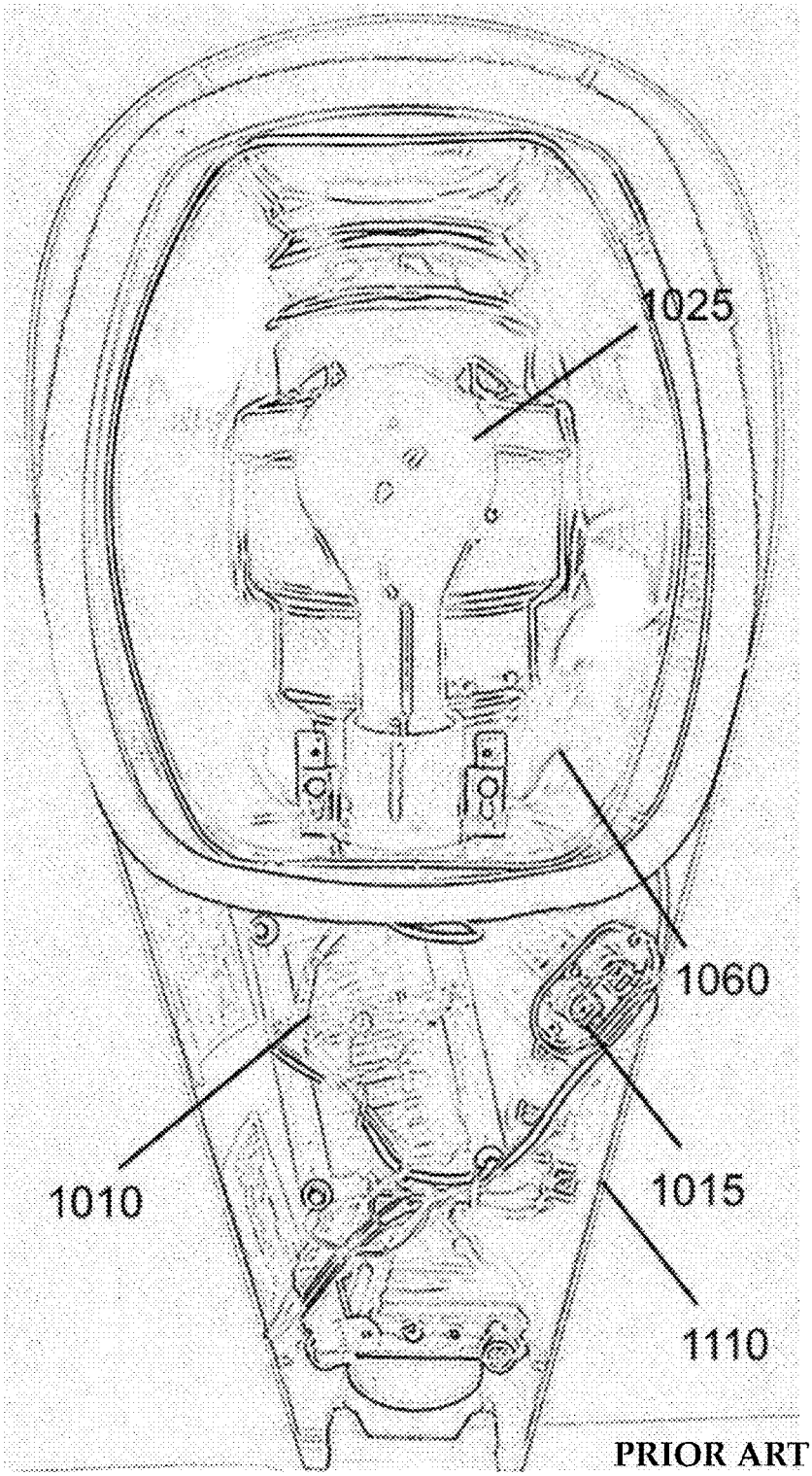
Figure 1D:
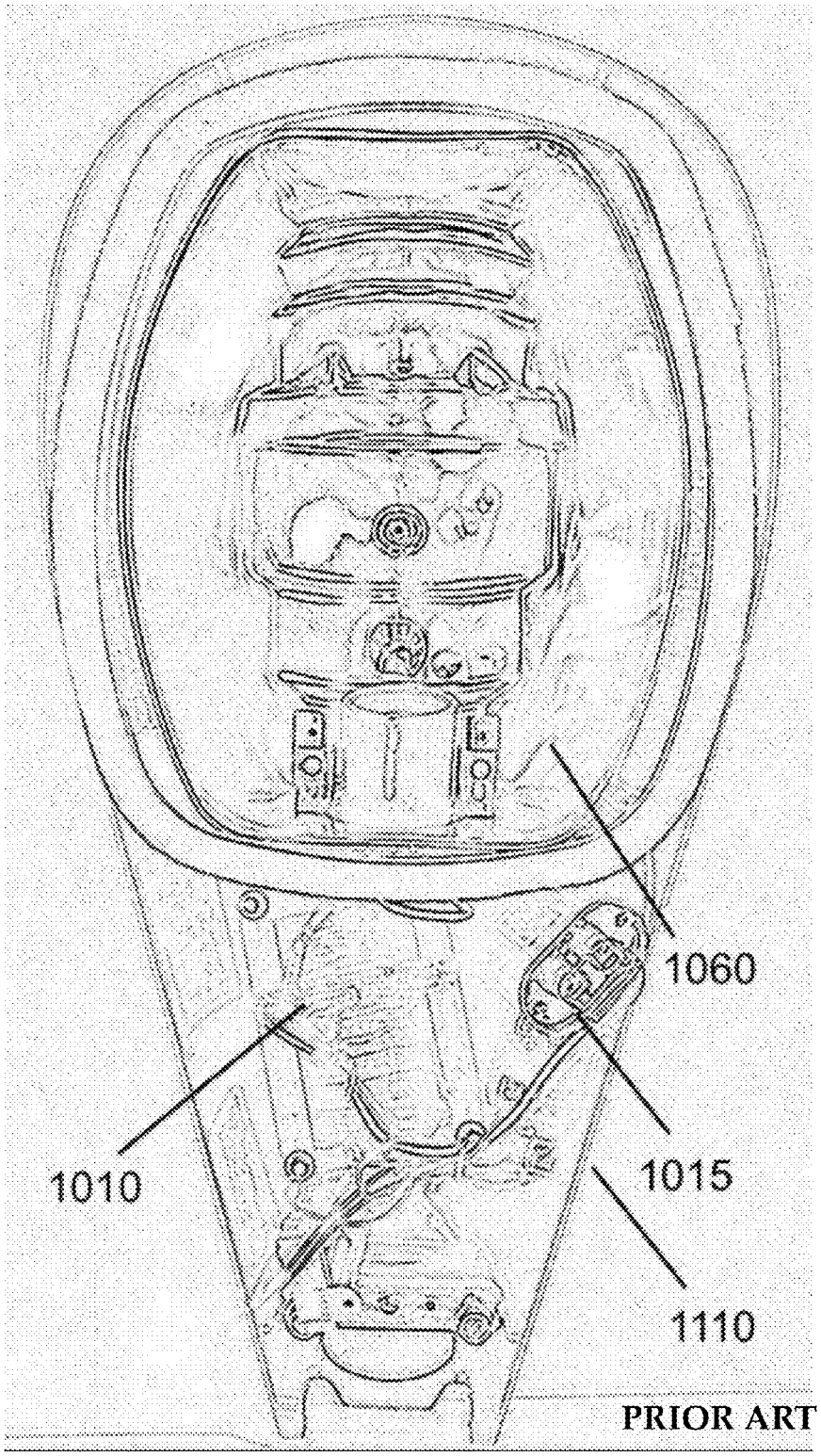
Figure 1E:
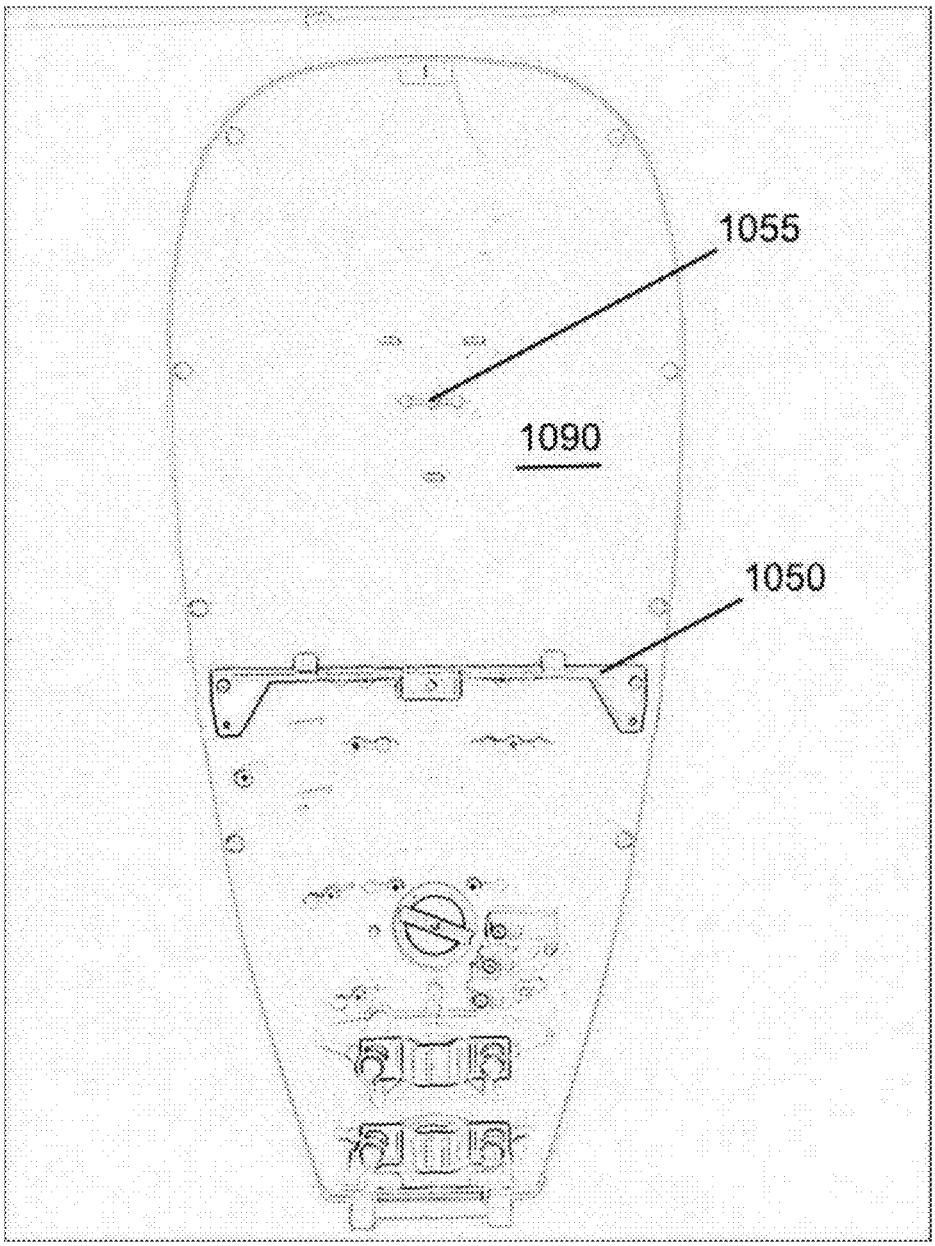
PRIOR ART FIG. 1E

FIGS. 1A-E collectively illustrate a roadway light 1000 that will be modified or retrofit using an LED lighting assembly of the present technology. As background, FIG. 1A illustrates that the roadway light 1000 comprises a housing 1110 and lens 1005. FIG. 1B illustrates a lower portion 1040 of the housing 1110 removed to expose a power supply 1015 and ballast 1010. The upper portion 1045 of the housing 1110 remains. In FIG. 1C the lens 1005 is removed to expose a bulb 1025 and reflector 1020. FIG. 1D illustrates the bulb 1025 removed and FIG. 1E illustrates the reflector 1020 removed, along with the power supply 1015 and ballast removed 1010 to expose a legacy bracket 1150 and legacy mount 1155 of the sidewall 1090 of the housing 1110.

The housing 1110 can be retrofit with an LED lighting assembly as described below.

Figure 2:
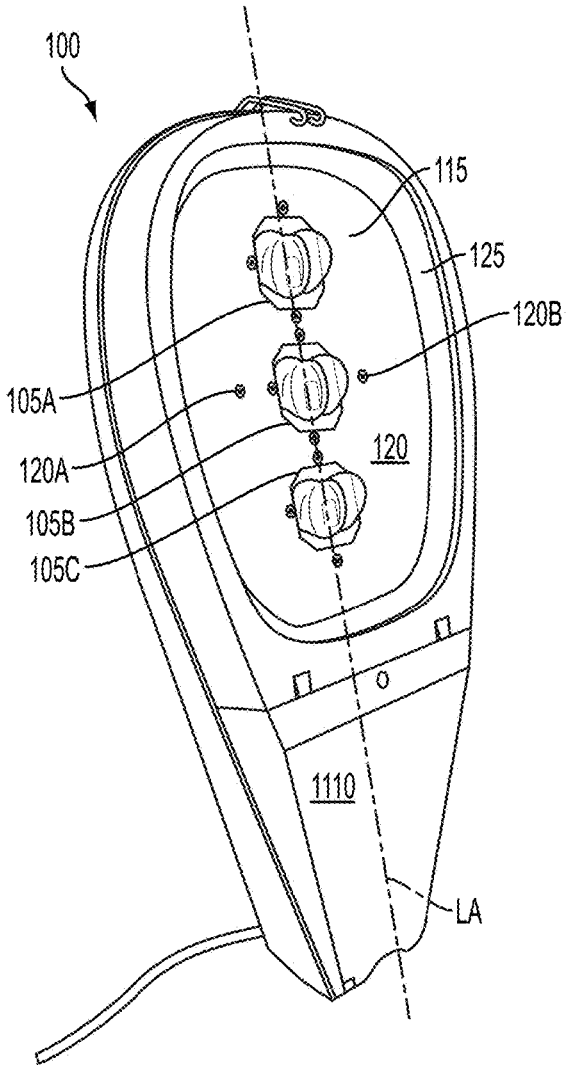
FIG. 2 is a perspective view of a retrofitted roadway light comprising an LED lighting assembly of the present technology.
Figure 3:
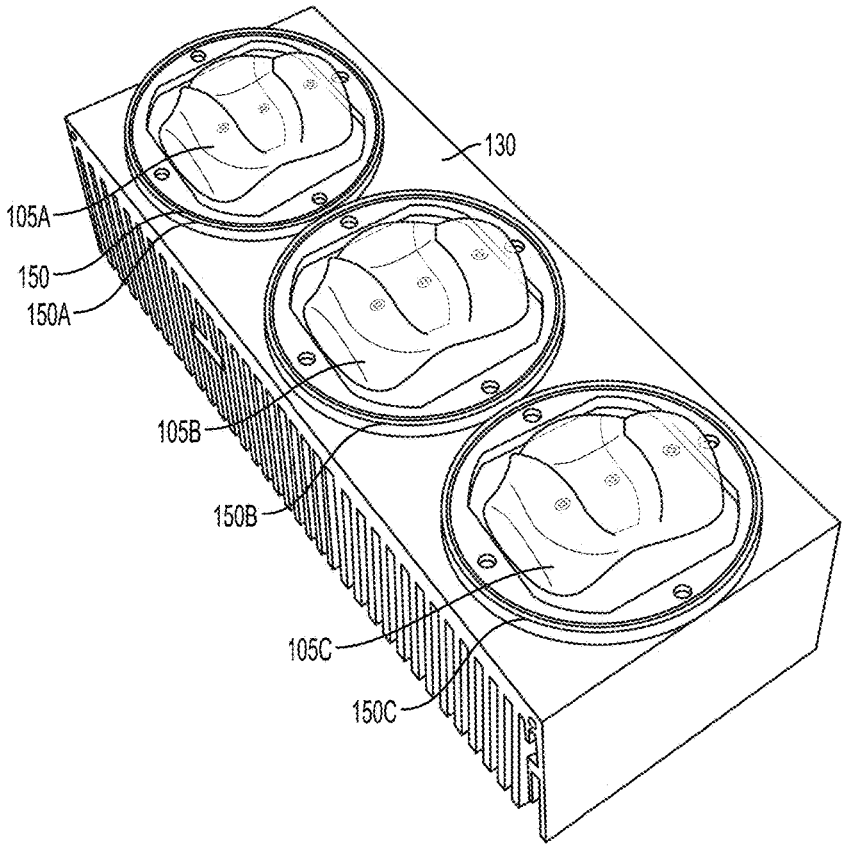
FIG. 3 is a perspective view of a heat sink in combination with LED lights.

Turning now to FIG. 2, when retrofit with an LED lighting assembly of the present technology, the existing lighting fixture may operate in a highly efficient manner, creating in excess of 105 lumens per watt of power utilized. Further, the retrofit lighting fixture may produce in excess of five foot-candles of lumens. Exemplary roadway fixtures that may be retrofit using the present technology include, but are not limited to a cobra head shaped fixture (e.g. exemplary LED lighting assembly 100) illustrated in FIG. 2. FIG. 2 illustrates an example retrofit lighting assembly 100 that includes a plurality of LED light sources 105A-C, a housing 1110, a transparent plate/film 115, a support plate 120, a spacer 125, and a heat sink 130 (FIG. 3). The assembly 100 can also comprise any required electronics for driving the LED lights.

The housing 1110 includes a traditional cobra head shaped roadway light enclosure. That is, the housing 1110 is a legacy housing of a roadway light (see FIGS. 1A-E) that remains during a retrofitting process. An example retrofitting process is described in greater detail below.

Turning to the present technology, FIG. 2 illustrates the plurality of exemplary LED light sources 105A-C. Each of the LED light sources 105A-C being mounted on a heat sink 130. It is noteworthy that each of the plurality of LED light sources 105A-C may be mounted on, and shares a single heat sink. Alternatively, each of the LED light sources 105A-C may have its own dedicated heat sink. The mounting of LED light sources 105A-C directly onto the heat sink 130 provides a further advantage of removing the need for any external fins on the housing 1110 to compensate for heat generated by the LED light sources. Indeed, the LED light sources 105A-C and heat sinks are entirely enclosed within the housing 1110 and require no further modifications to the housing 1110 to allow for heat transfer. Further, the modular nature of the LED light source and heat sink combination allow for scalability and flexible use of the present technology in a wide variety of fixtures of different shapes and sizes.

Each of the LED light sources 105A-C is joined to the heat sink 130 using a base plate, such as base plate 150A-C associated with LED light sources 105A-C. The base plate 150 comprises a ring 150A-C with interfaces for receiving fasteners.

Each of the LED light sources 105A-C is also joined with a support plate 120 (FIG. 4) by disposing fasteners in the interfaces. More specifically, the support plate 120 includes apertures, such as aperture 160 that are disposed around the openings, such as opening 165. The openings are sized to receive the LED light sources 105A-C. Fasteners are inserted through the apertures into interfaces in the base plates to secure the LED light sources 105A-C and heat sink 130 to the support plate 120.

The support plate 120 may be fabricated from a material such as aluminum, although other suitable materials that would be known to one of ordinary skill in the art are also likewise contemplated for use. The LED light sources 105A-C are arranged onto the heat sink 130 in a linear manner along a long axis LA of the housing 1110. The arrangement of the LED light sources 105A-C allows for the LED light sources 105A-C to replicate the light pattern produced by a traditional incandescent, HID, or HPS lamps, which also extend along the long axis LA.

In some embodiments, the support plate 120 comprises a mating bracket 170. This mating bracket 170 can include a substantially L-shaped bracket that includes threaded studs 175A and 175B. These threaded studs are spaced apart from one another so as to align with the two apertures 145A and 145B of the legacy bracket 1150.

In one embodiment, the support plate 120 is secured using wing bolts 180A and 180B, which thread onto the threaded studs 175A and 175B of the mating bracket 170.

According to some embodiments, the assembly 100 can also comprise a pair of lateral apertures 120A and 120B that receive fasteners for coupling the support plate 120 to a v-shaped bracket that is installed in the housing 1110, as will be described in greater detail below.

FIG. 3 illustrates the plurality of exemplary LED light sources 105A-C. Each of the LED light sources 105A-C being mounted on a heat sink. For example, LED light sources 105A-C are both mounted on a heat sink 130. It is noteworthy that each of the plurality of LED light sources 105A-C may be mounted on, and shares a single heat sink. Alternatively, each of the LED light sources 105A-C may have its own dedicated heat sink, such as with LED light source 105C. The mounting of LED light sources 105A-C directly onto heat sinks provides a further advantage of removing the need for any external fins on the housing 1110 to compensate for heat generated by the LED light sources, as mentioned above. Indeed, the LED light sources 105A-C and heat sinks are entirely enclosed within the housing 1110 and require no further modifications to the housing 1110 to allow for heat transfer. Further, the modular nature of the LED light source and heat sink combination allow for scalability and flexible use of the present technology in a wide variety of fixtures of different shapes and sizes.

Each of the LED light sources 105A-C is provided with a lens, such as a lens 145 associated with LED light source 105A.

Figure 4:
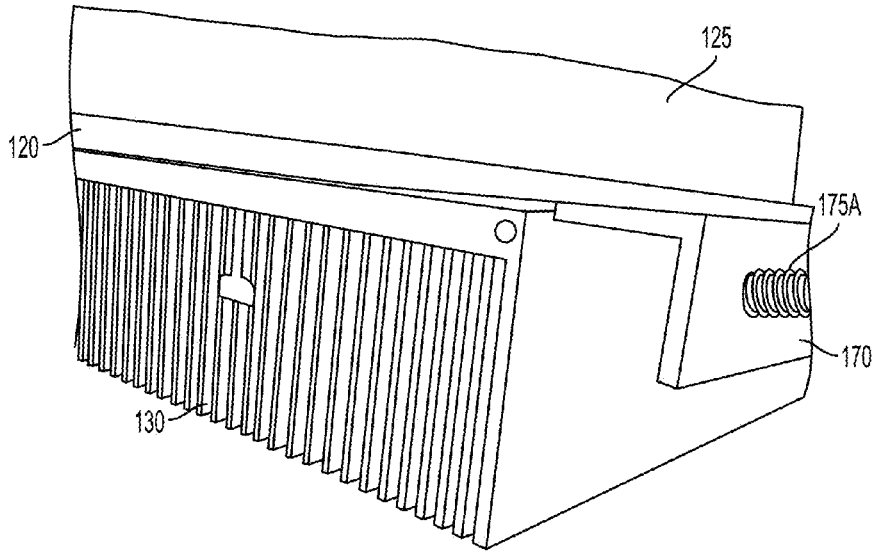
FIG. 4 is a partial perspective view of the heat sink in combination with a support plate and mating bracket.
Figure 5:
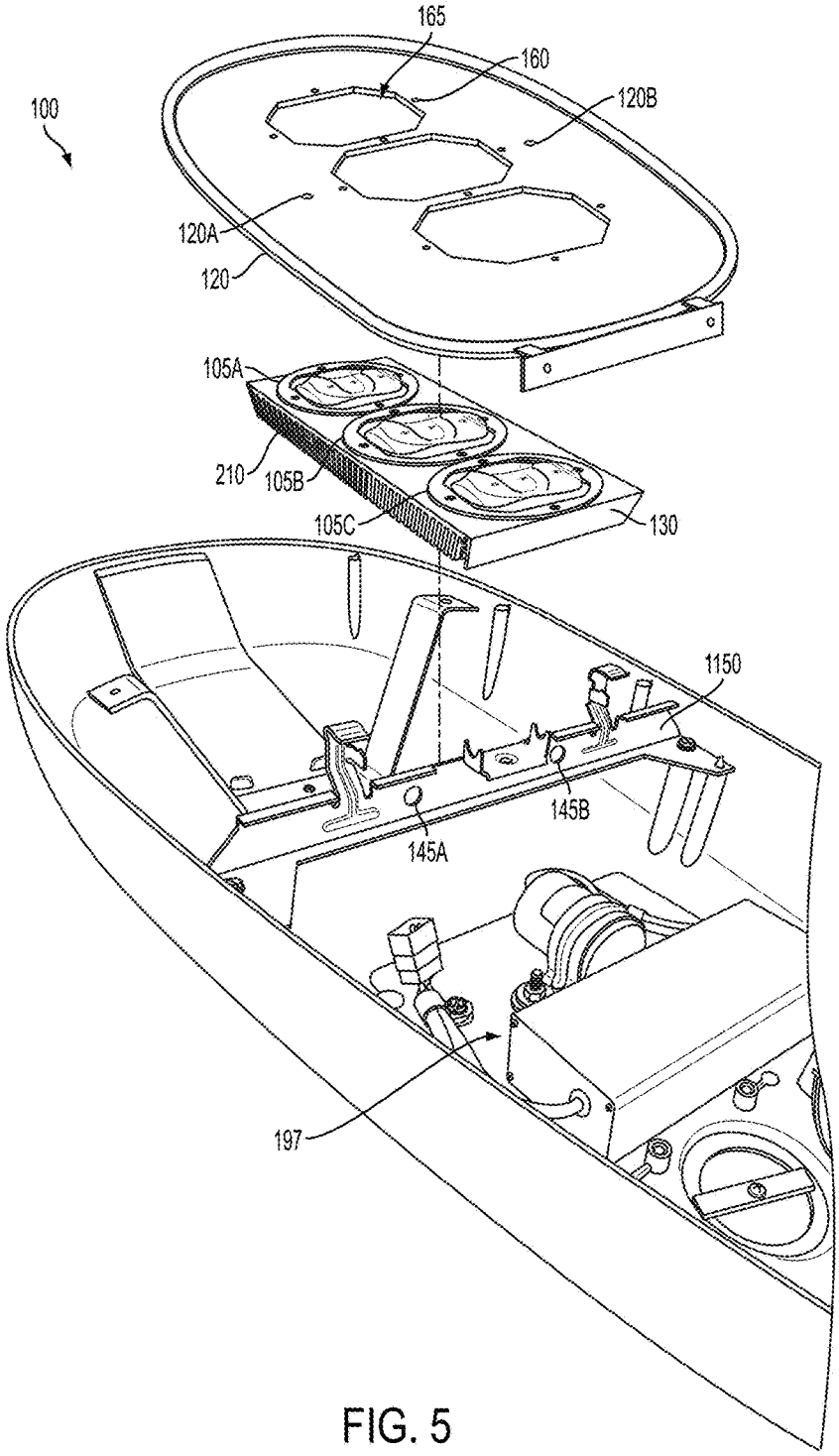
FIG. 5 is an exploded view showing the support plate, the heat sink with LED lights, a legacy bracket, and a v-shaped bracket installed into a housing of the roadway light.
Figure 6:
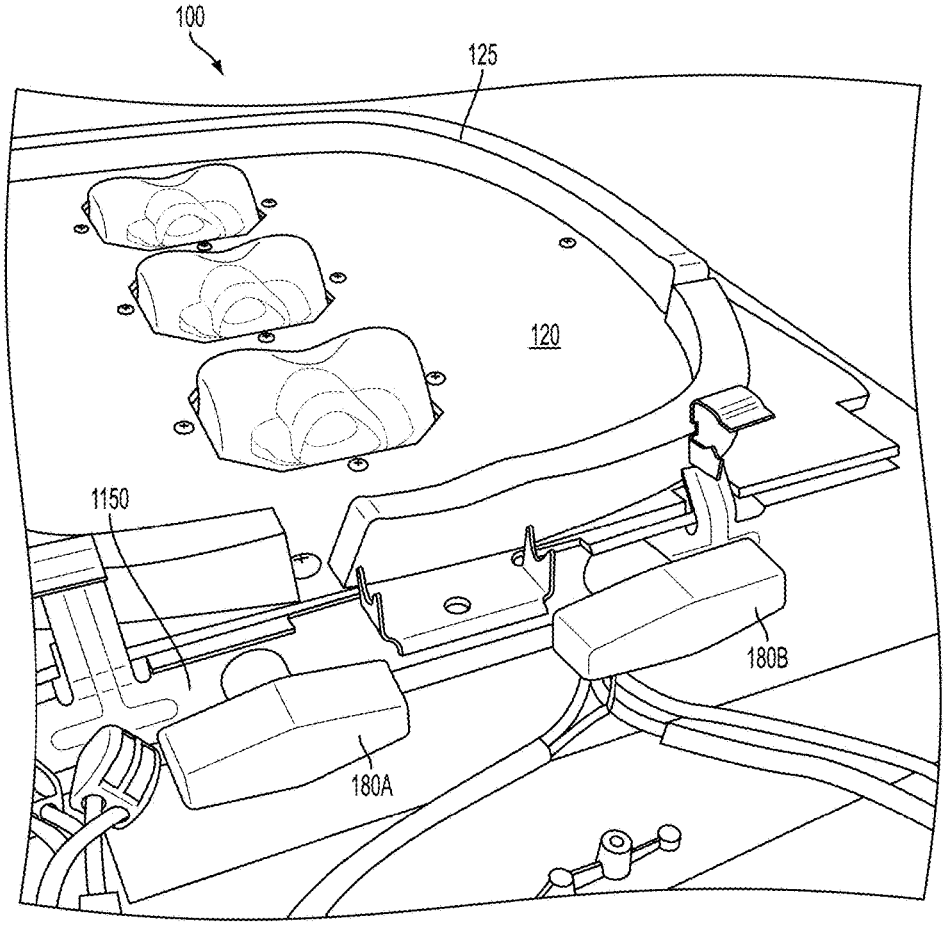
FIG. 6 is a perspective view of the LED lighting assembly shown in an installed configuration on the legacy bracket of the roadway light.

Referring now to FIGS. 4-6, the assembly 100 may also include a spacer 125 that is placed between the transparent plate 115 and the support plate 120. In some instances the spacer 125 is fabricated from an insulating material.

Also, rather than utilizing a traditional borosilicate lens, the assembly 100 includes the transparent plate 115 that covers the LED light sources 105A-C. Roadway lighting fixtures that do not include a traditional borosilicate lens are less costly to maintain as such lenses are expensive to replace when damaged. Further, roadway lighting fixtures may be created using the present technology, thus leading to reduced manufacturing cost per unit as compared to a traditional roadway lighting fixture. Stated otherwise, in addition to the utility of the present technology with respect to retrofitting exiting fixtures, the present technology may be fabricated into new lighting fixtures. It will be understood that the transparent plate 115 may include a partially transparent plate or a colored plate. Also, the transparent plate 115 is used in place of the lens 1005 of the legacy roadway light.

It is noteworthy that the present technology does not require any modification of the housing 1110 to compensate for heat produced by the LED light sources 105A-C. This advantage is due to the efficiency with which the LED light sources 105A-C produce and emit light, as well as their integration with a heat sink(s) 130 that are configured to fit within the housing 1110.

The LED lighting assembly 100 that can be installed in an efficient manner in a streetlight housing. The LED lighting assembly 100 can be installed onto the legacy bracket 1150 that is used as an anchor for a hinged cover of the original streetlight. The LED lighting assembly 100 can be coupled to the housing 1110 using the legacy bracket 1150.

In one embodiment, the assembly 100 comprises a v-shaped bracket 195 that is installed on a legacy thread mount 1155 of the housing 1110. That is, when the existing components of the roadway light are removed from the roadway light (shown in FIGS. 1A-E), the components for installing the assembly 100 can be fastened to legacy brackets and thread mounts, such as legacy thread mounts 1155 of the streetlight housing 1110.

The v-shaped bracket 195 comprises flattened ends 195A and 195B that each comprise an aperture that receives a fastener that has been inserted through one of the lateral apertures 120A and 120B of the support plate 120.

Referring back to FIGS. 1A-E, in an example method for retrofitting a legacy roadway light, a cover 110A is unlatched or disconnected from the housing 1110 to expose the inner contents of the housing 1110. For example, the ballast 1010, lens 1005, reflector 1020, and lamp 1025. Each of these components is removed. Again, in some embodiments, a legacy bracket 1150 is left in place within the housing 1110.

Figure 7:
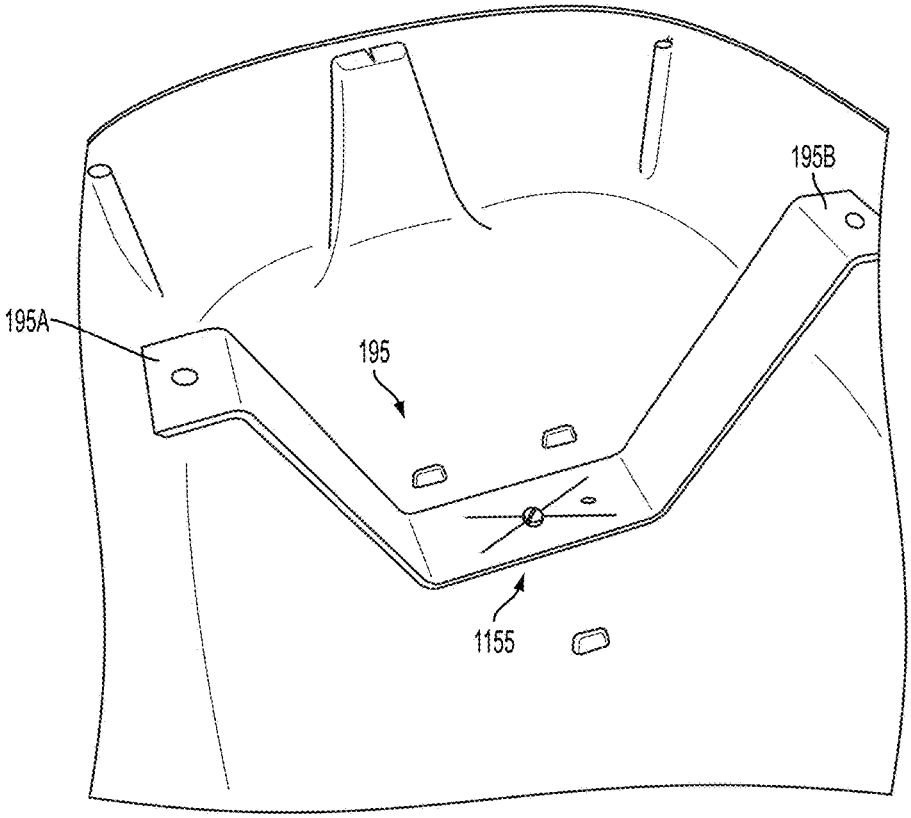
FIG. 7 is a perspective view of the v-shaped bracket installed in the housing of the roadway light, prior to installation of the support plate and heat sink with LED lights.

FIGS. 2-7 collectively illustrate the components of the LED assembly 100 that are installed into the housing 1110. For example, the v-shaped bracket 195 is installed onto the legacy thread mount 1155 of the housing 1110, as shown in FIG. 7. The support plate 120, the LED light sources 105A-C, and the heat sink 130, as an assembled unit, are placed into the housing 1110, as in FIG. 5. The threaded studs 175A and 175B of the L-shaped mating bracket 170 are aligned and inserted into the two apertures 145A and 145B of the legacy bracket 1150, as in FIG. 6. The wing bolts are threaded onto the threaded studs 175A and 175B and the electronics of the assembly 100 are connected to a singular power supply. The power supply can include the original power supply of the fixture or a new power supply 197, see FIG. 5.

A legacy bracket 1050 is left in place within the housing 1110. The legacy bracket 1050 comprises two apertures 145A and 145B (FIG. 5) that originally provided an interface for the reflector 1020 (see FIG. 1C).

It is noteworthy that while the above example mentions the use of threaded studs 175A and 175B, the L-shaped mating bracket 170 can alternatively comprise apertures in place of the threaded studs 175A and 175B. These apertures would be aligned with the apertures 145A and 145B of the legacy bracket 1050 and fasteners would be inserted therein.

The support plate 120 is secured to the v-shaped bracket 195 by aligning the apertures of the flattened ends 195A and 195B of the v-shaped bracket 195 with the lateral apertures 120A and 120B of the support bracket 120.

Figure 8:
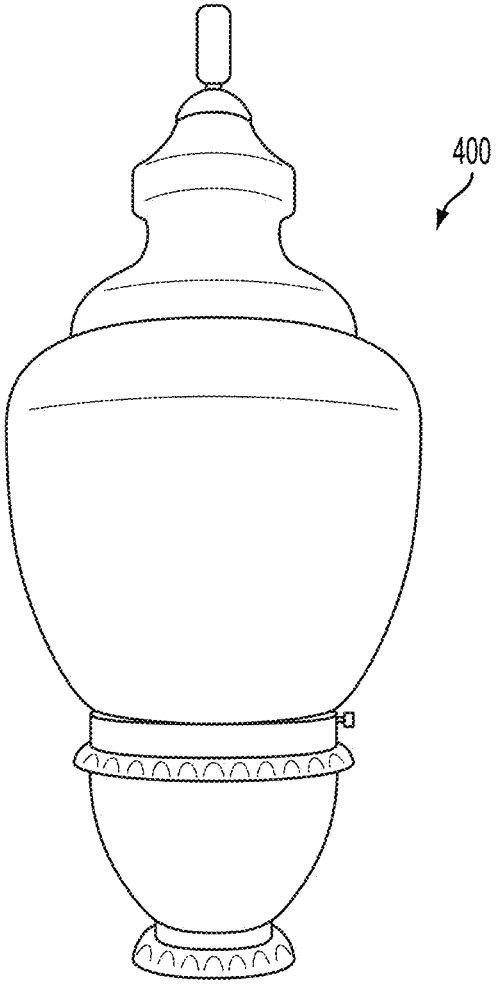
FIG. 8 is another example retrofit light in the form of an acorn streetlight.
Figure 9:
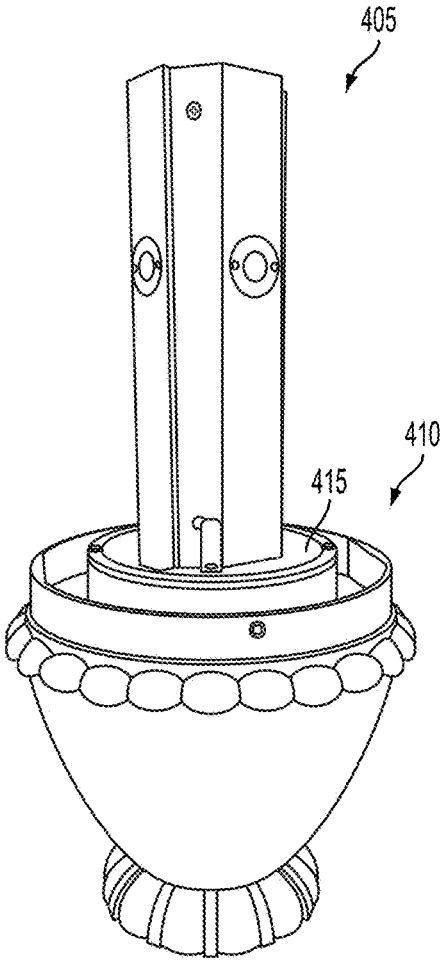
FIG. 9 is a perspective view of the acorn streetlight that has been retrofit with a columnar LED lighting assembly of the present technology.
Figure 10:
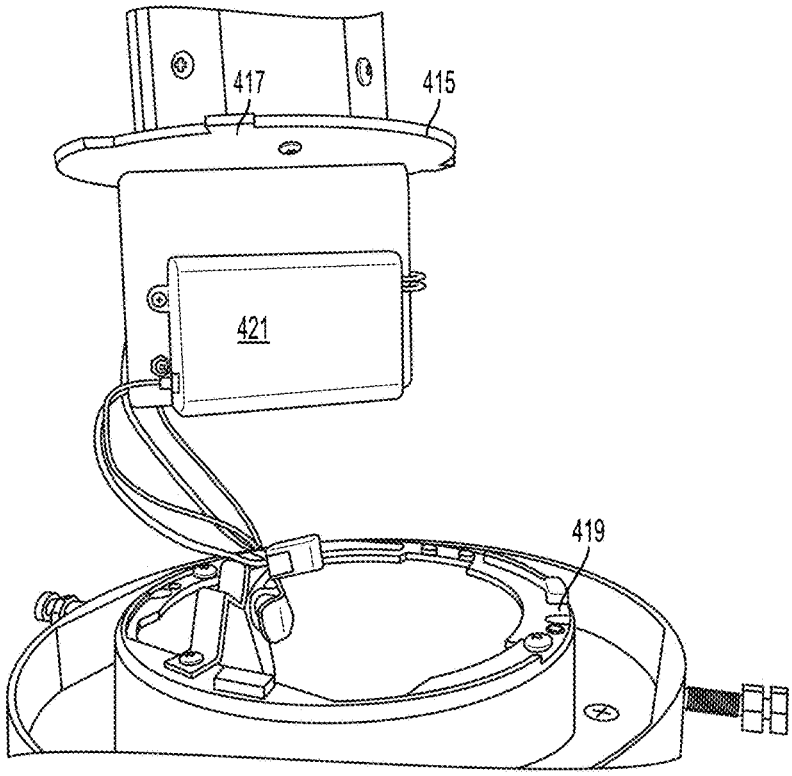
FIG. 10 is a perspective view of a portion of the columnar LED lighting assembly showing the mounting plate and base of the acorn streetlight.

FIGS. 8-13 collectively illustrate another retrofit lighting fixture in the form of a traditional gas lamp-style light. These lights often utilize the same type of HID or HPS bulbs as roadway lights. FIG. 8 is a perspective view of a retrofit lighting fixture 400 having an outer glass cover. FIG. 9 is a perspective view of the fixture 400 with the outer glass cover removed. An LED lighting assembly 405 is associated with a legacy base 410, via a mounting plate 415, which is best illustrated in FIG. 10, which also illustrates a power source 421 that is used to drive LED light sources of the assembly 405.

Figure 11:
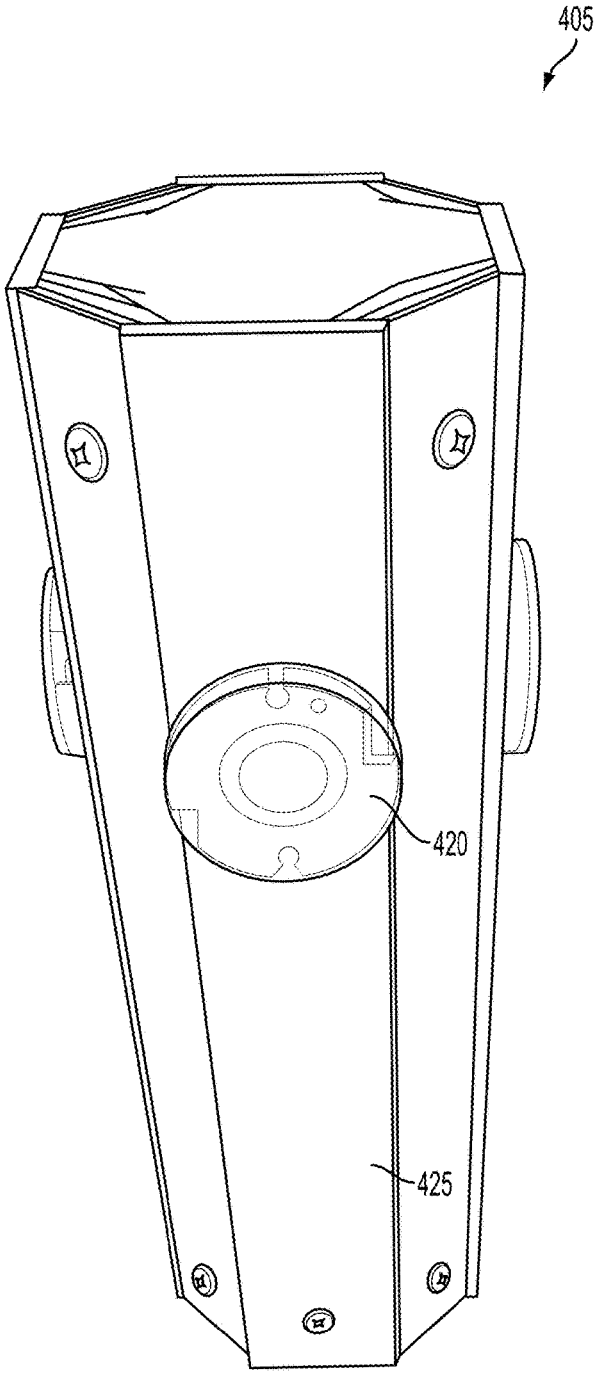
FIG. 11 is a perspective view of a columnar heat sink with LED lights associated therewith.
Figure 12:
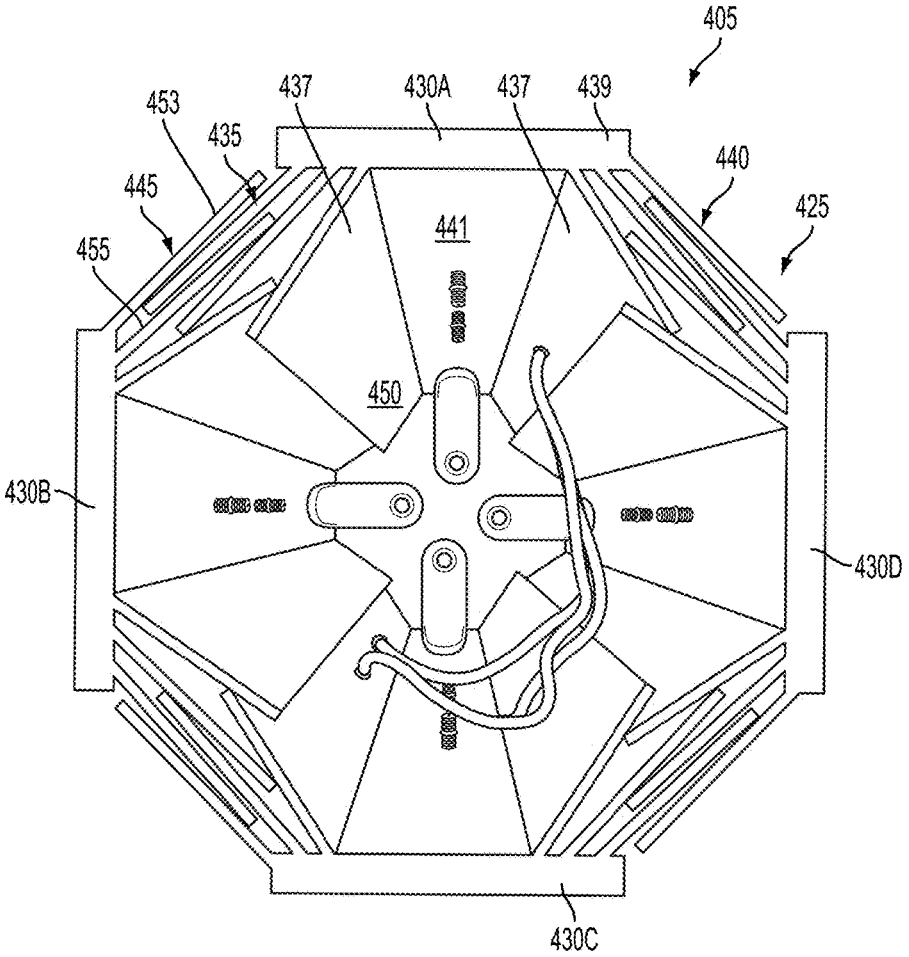
FIG. 12 is a top plan view of the columnar heat sink showing fins of adjacent heat sinks in a mated configuration.

FIG. 11 is a perspective view of the LED lighting assembly 405, showing one of four LED light sources 420. The LED light source 420 is mounted on a heat sink 425, which is comprised of a plurality of interconnected heat sinks sections that are best illustrated in FIG. 12, which is a top down view of the LED lighting assembly 405.

The heat sink 425 is comprised of four heat sink sections 430A-D, where each section is associated with a LED light source. Each of the sections, such as section 430A, includes a plurality of fins 437 that extend from a body 439. The plurality of fins 437 will fan out from an upper surface 441 of the body 439.

Fins of adjacent heat sinks are meshed together. For example, section 430A includes four leftmost fins 435 and four rightmost fins 440. The fins of the section 430A are angled, and adjacent fins are spaced apart from one another such that the fins 445 of an adjacent section 430B can mesh or intermingle with fins of section 430A. When sections 430A-D are connected together they form a column 450 that provides a path 455 for the dissipation of heat generated by the LED light sources.

In some embodiments, a first fin 453 of section 430A overlaps a last fin 455 of section 430B in such a way that the fin surfaces of first fin 453 and last fin 455 contact one another face-to-face. It will be understood that the sections 430A-D can each include fewer or more fins than those shown in the figures. Moreover, in some embodiments, the first fin 453 and last fin 455 extend from their respective bodies at an angle that is approximately 45 degrees relative to a midline of a section body.

Figure 13:
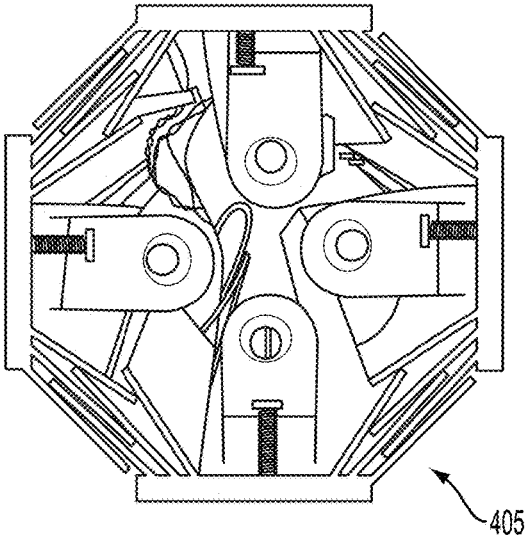
FIG. 13 is a bottom plan view of the columnar heat sink showing fins of adjacent heat sinks in a mated configuration.

FIG. 13 illustrates a bottom view of the LED lighting assembly 405, which includes a plurality of brackets that are utilized to join the sections 430A-D to the mounting plate 415. Each of the sections includes an aperture that aligns with an aperture on the mounting plate 415. Fasteners are used to join the mounting plate 415 to the LED lighting assembly 405 through the aligned apertures.

To install the LED lighting assembly 405, the HID or HPS bulb and its associated assembly are removed from the base 410 of the fixture 400. The LED lighting assembly 405 as shown in FIG. 9 is connected to the power leads of the fixture 400, and the mounting plate 415 is associated with the base 410. Once the LED lighting assembly 405 is installed, the outer glass cover can be replaced.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A retrofit roadway light, comprising:

a heat sink;

a plurality of light emitting diode (LED) lights mounted to the heat sink, the plurality of LED lights being disposed in a linear arrangement that is aligned with a long axis of a housing of the retrofit roadway light;

a support plate having openings that receive the plurality of LED lights, the support plate being joined to the heat sink, the support plate comprising a mating bracket that comprises an L-shaped bracket having a first portion that extends parallel to the support plate and a downwardly extending portion perpendicular to the first portion, the downwardly extending portion comprising two studs, the two studs extending through apertures in a legacy bracket disposed within a housing of the roadway light, the support plate being joined to the legacy bracket by fasteners that couple with the two studs;

a v-shaped bracket installed onto a legacy mount that is integrated into a sidewall of the housing, the support plate being joined to flattened ends of the v-shaped bracket; and a transparent film to cover an opening of a lower portion of the housing.

2. The retrofit roadway light according to claim 1, wherein each of the plurality of LED lights is mounted onto the heat sink with a base plate that comprises a ring with interfaces that receive fasteners.

3. The retrofit roadway light according to claim 1, further comprising an insulating spacer disposed between the transparent film and the support plate, the insulating spacer being attached around an outer portion of the support plate.

4. The retrofit roadway light according to claim 1, wherein the heat sink is disposed between the support plate and the sidewall of an upper portion of the housing.

5. The retrofit roadway light according to claim 1, wherein the v-shaped support bracket comprises flattened ends that each comprise an aperture, the apertures of the flattened ends being aligned with lateral apertures of the support plate so as to receive fasteners.

6. The retrofit roadway light according to claim 5, wherein the flattened ends are spaced apart from the sidewall of the housing.

7. A method, comprising:

opening a housing of a roadway light that comprises a ballast, an incandescent lamp, a reflector, a lens, a legacy bracket, and a legacy mount disposed in a sidewall of the housing;

removing the lens, which is associated with a lower portion of the housing to create an opening in the lower portion;

removing the ballast, the incandescent lamp, and the reflector; and coupling an assembly to the legacy bracket, the assembly comprising:

a plurality of light emitting diode (LED) lights mounted to the heat sink, the plurality of LED lights being disposed in a linear arrangement that is aligned with a long axis of a housing of the retrofit roadway light; and a support plate having openings that receive the plurality of LED lights, the support plate being joined to the heat sink, the support plate comprising a mating bracket that comprises an L-shaped bracket having a first portion that extends parallel to the support plate and a downwardly extending portion perpendicular to the first portion, the downwardly extending portion comprising two studs, the two studs extending through apertures in a legacy bracket disposed within a housing of the roadway light, the support plate being joined to the legacy bracket by fasteners that couple with the two studs.

8. The method according to claim 7, further comprising installing a transparent plate in the opening in the lower portion.

9. The method according to claim 8, further comprising installing a v-shaped support bracket onto the legacy mount.

10. The method according to claim 9, further comprising aligning apertures of flattened ends of the v-shaped support bracket with lateral apertures of the support plate so as to receive fasteners to join the v-shaped support bracket with the support plate.

11. The method according to claim 10, further comprising creating the assembly by:

mounting the plurality of LED lights onto the heat sink in a linear arrangement; and joining the heat sink to the support plate such that lenses of the plurality of LED lights extend through openings of the support plate.

12. The method according to claim 11, further comprising joining the mating bracket to the support plate.

13. A method, comprising:

providing a roadway light that comprises a housing, the roadway light having at least a ballast, an incandescent lamp, a reflector, a lens removed therefrom, the roadway light comprising a legacy bracket and a legacy mount disposed in a sidewall of the housing that remain; and coupling an assembly to the legacy bracket, the assembly comprising:

a plurality of light emitting diode (LED) lights mounted to the heat sink, the plurality of LED lights being disposed in a linear arrangement that is aligned with a long axis of a housing of the retrofit roadway light; and a support plate having openings that receive the plurality of LED lights, the support plate being joined to the heat sink, the support plate comprising a mating bracket that comprises an L-shaped bracket having a first portion that extends parallel to the support plate and a downwardly extending portion perpendicular to the first portion, the downwardly extending portion comprising two studs, the two studs extending through apertures in a legacy bracket disposed within a housing of the roadway light, the support plate being joined to the legacy bracket by fasteners that couple with the two studs.

14. The method according to claim 13, further comprising installing a transparent plate in the opening in the lower portion.

15. The method according to claim 14, further comprising installing a v-shaped support bracket onto the legacy mount.

16. The method according to claim 15, further comprising aligning apertures of flattened ends of the v-shaped support bracket with lateral apertures of the support plate so as to receive fasteners to join the v-shaped support bracket with the support plate.

17. The method according to claim 16, further comprising creating the assembly by:

mounting the plurality of LED lights onto the heat sink in a linear arrangement; and joining the heat sink to the support plate such that lenses of the plurality of LED lights extend through openings of the support plate.

18. The method according to claim 17, further comprising joining the mating bracket to the support plate.

* * * * *